US009565908B2

(12) United States Patent
Gavrieli et al.

(10) Patent No.: US 9,565,908 B2
(45) Date of Patent: Feb. 14, 2017

(54) APPARATUS AND METHODS FOR CARRYING FOOTWEAR

(71) Applicant: Gavrieli Brands, LLC, Beverly Hills, CA (US)

(72) Inventors: Kfir Gavrieli, Los Angeles, CA (US); Dikla Gavrieli, Los Angeles, CA (US)

(73) Assignee: Gavrieli Brands LLC, Beverly Hills, CA (US)

( * ) Notice: Subject to any disclaimer, the term of this patent is extended or adjusted under 35 U.S.C. 154(b) by 0 days.

(21) Appl. No.: 14/882,145

(22) Filed: Oct. 13, 2015

(65) Prior Publication Data

US 2016/0029755 A1 Feb. 4, 2016

Related U.S. Application Data

(62) Division of application No. 13/207,399, filed on Aug. 10, 2011, now Pat. No. 9,167,862.

(51) Int. Cl.

| | |
|---|---|
| ***A45C 3/12*** | (2006.01) |
| ***A45C 3/00*** | (2006.01) |
| ***A45C 13/10*** | (2006.01) |
| ***A43B 3/24*** | (2006.01) |

(52) U.S. Cl.

CPC ..... *A45C 3/12* (2013.01); *A43B 3/248* (2013.01); *A45C 3/00* (2013.01); *A45C 13/1046* (2013.01)

(58) Field of Classification Search

CPC ..... A45C 7/0045; A45C 3/12; A45C 13/1045; A45C 3/00; A45C 3/04

USPC ..... 206/278; 150/111; 190/108; 36/1, 136; 383/2, 37, 75

See application file for complete search history.

(56) References Cited

U.S. PATENT DOCUMENTS

| | | | | | |
|---|---|---|---|---|---|
| 1,818,030 | A * | 8/1931 | Arnold | A45C 3/12 | 383/38 |
| 2,164,641 | A * | 7/1939 | Davenport | A45C 7/0077 | 383/127 |
| 5,009,516 | A * | 4/1991 | Geeck | A45C 3/04 | 206/37.1 |
| 5,046,860 | A * | 9/1991 | Brennan | A45C 13/02 | 150/111 |
| 5,123,967 | A * | 6/1992 | Arneson | A47L 21/02 | 134/22.1 |
| 5,209,385 | A * | 5/1993 | Ledesma | A45C 1/04 | 224/223 |

(Continued)

*Primary Examiner* — Sue A Weaver

(74) *Attorney, Agent, or Firm* — Morgan, Lewis & Bockius LLP

(57) ABSTRACT

An apparatus for carrying foldable footwear that comprises a drawstring pouch having a side pocket that reversibly adjusts between undrawn and drawn states. When undrawn, the pouch is characterized by an opening at the top of the pouch that is dimensioned and configured for receiving a pair of foldable shoes in an interior of the pouch. When drawn, the pouch is characterized by a drawstring arranged on the upper portion sealing off the opening, thereby concealing the interior of the pouch. The apparatus further comprises a collapsible tote bag removably inserted in the side pocket, where the tote bag is configured to reversibly convert between unfolded and folded states. When unfolded, the tote bag is characterized by an interior portion that receives a pair of unfolded shoes, where the interior portion further includes a storage pocket. When folded, the tote bag is completely contained within the second pocket.

20 Claims, 16 Drawing Sheets

(56) References Cited

U.S. PATENT DOCUMENTS

| | | | | |
|---|---|---|---|---|
| 5,490,619 | A * | 2/1996 | Boyar | A45F 3/02 150/103 |
| D610,785 | S * | 3/2010 | Smith | D2/947 |
| 7,735,244 | B1 * | 6/2010 | Ameche | A43B 3/24 36/102 |
| 9,167,862 | B2 * | 10/2015 | Gavrieli | A45C 3/12 |
| 2005/0229428 | A1 * | 10/2005 | Holcomb | A43B 3/16 36/7.1 R |
| 2006/0168915 | A1 * | 8/2006 | Downing-Perrault | B65B 25/00 53/449 |
| 2008/0101731 | A1 * | 5/2008 | Carlson | E01H 1/1206 383/41 |
| 2009/0272009 | A1 * | 11/2009 | Weisner | A43B 3/101 36/102 |
| 2010/0018080 | A1 * | 1/2010 | Smith | A43B 3/24 36/102 |
| 2010/0034488 | A1 * | 2/2010 | Jariwala | B65D 27/08 383/38 |
| 2010/0115793 | A1 * | 5/2010 | Kraisosky | A43B 3/0078 36/94 |
| 2010/0260443 | A1 * | 10/2010 | Ramirez | B65D 29/04 383/75 |
| 2013/0186786 | A1 * | 7/2013 | Curtis | B65D 85/187 206/278 |
| 2013/0292014 | A1 * | 11/2013 | Mosee | A45C 1/02 150/107 |

* cited by examiner

APPARATUS AND METHODS FOR CARRYING FOOTWEAR

CROSS REFERENCE TO RELATED APPLICATIONS

This application is a divisional of U.S. patent application Ser. No. 13/207,399, now U.S. Pat. No. 9,167,862, issued Oct. 27, 2015, and entitled "Apparatus and Methods for Carrying Footwear," which is hereby incorporated by reference herein in its entirety.

FIELD OF THE DISCLOSURE

The present disclosure relates to an apparatus for carrying foldable footwear and methods for using same.

BACKGROUND

In a continued effort to streamline women's accessories and provide more footwear options for women, a class of footwear known as foldable shoes has become popular.

Various bags and pouches have been designed to hold foldable shoes so that a woman may carry such shoes within a bag or a purse, while wearing conventional shoes, until such a time that the foldable shoes are desired. Then, when desired, the foldable shoes can be removed from the bag or pouch and used. The prior art further provides tote bags to place the conventional shoes in while the foldable shoes are being worn.

While systems that include both a pouch for the foldable shoes and a tote bag for the conventional shoes provide a significant advance in the effort to streamline women's accessories and provide more footwear options for women, there is significant room for improvement. For instance, the provision of a pouch for the foldable shoes and a tote bag for conventional shoes leads to disorganization and clutter. There are a multitude of parts involved: (i) a purse, (ii) a pouch for the foldable shoes, and (iii) a tote bag for the conventional shoes. Moreover, the pouch that holds the collapsible shoes becomes easily lost within the depths of a purse when the pouch is empty.

Given the above background, what is needed in the art are improved systems and methods for carrying foldable footwear and methods for using same.

SUMMARY

The present disclosure addresses the preceding and other shortcomings of the prior art by providing an apparatus for carrying foldable footwear. The apparatus comprises a drawstring pouch having a side pocket. The drawstring pouch is reversibly configured to adjust between (i) an undrawn state and (ii) a drawn state. When in the undrawn state, the drawstring pouch is characterized by an opening at the top of the drawstring pouch that is dimensioned and configured for receiving a pair of foldable shoes in an interior of the drawstring pouch. When in the drawn state, the drawstring pouch is characterized by a drawstring arranged on the upper portion that seals off the opening, thereby concealing the interior of the drawstring pouch. The apparatus further comprises a collapsible tote bag removably inserted in the side pocket, where the collapsible tote bag is configured to reversibly convert between (i) an unfolded state and (ii) a folded state. When in the unfolded state, the collapsible tote bag is characterized by an interior portion that is configured to receive a pair of unfolded shoes, where the interior portion further includes a storage pocket. When in the folded state, the collapsible tote bag is characterized by being completely contained within the storage pocket.

An example of the type of foldable shoe that may be accommodated in the drawstring pouch is one having an upper, midsole, heel and toe and heel outsole patches. The upper forms an interior portion for receiving a foot of a woman, and this interior portion includes a toe cavity and a heel cavity. The midsole has (i) a toe end, (ii) a heel end, (iii) an inner side, and (iv) an outer side, where a perimeter of the midsole is stitched to the upper thereby forming a bottom to the interior portion that is bounded by a first seam. The heel outsole patch is stitched onto a heel portion of a first face of the midsole and the toe outsole patch is stitched onto a toe portion of the first face of the midsole. There is a spacing between (i) the heel outsole patch stitched onto the heel portion of the first face of the midsole and (ii) the toe outsole patch stitched onto the toe portion of the first face of the midsole, the spacing extending from the inner side to the outer side and occupying a position intermediate the toe end and the heel end thereby permitting the entire shoe to fold about an axis in the spacing running between the inner side and the outer side. This exemplary shoe is configured to fold between (i) an extended state in which the heel outsole patch and the toe outsole patch are coplanar and (ii) a folded state in which the shoe is bent about the axis such that a portion of the shoe comprising the toe cavity is tucked into the heel cavity. The pair of shoes is in the folded state when the pair of foldable shoes is received in the interior of the drawstring pouch.

In some embodiments, the tote bag and/or the drawstring pouch is made out of a synthetic fabric. In some embodiments, the tote bag and/or the drawstring pouch is made out of a fabric comprising rayon, acetate, nylon, modacrylic, olefin, acrylic, polyester, lycra or carbon fiber. In some embodiments, the drawstring pouch and the collapsible tote bag are stored in a box having a removable lid.

Another aspect of the present disclosure provides a method for carrying foldable footwear. The method comprises obtaining a drawstring pouch having a side pocket, where the drawstring pouch is in a drawn state that is characterized by a drawstring arranged on an upper portion of the drawstring pouch, the drawstring sealing off an opening at the top of the drawstring pouch thereby concealing an interior of the drawstring pouch. The method further comprises pulling on the upper portion of the drawstring pouch thereby releasing the drawstring and exposing the opening. The method further comprises removing a pair of folded shoes from the interior of the drawstring pouch when the opening is exposed. The method further comprises removing a collapsible tote bag from the storage pocket on an exterior of the drawstring pouch, where the collapsible tote bag is in a folded state in which the collapsible tote bag is completely contained within a storage pocket of the collapsible tote bag. The method further comprises unfolding the collapsible tote bag to an unfolded state, the unfolded state characterized by an interior portion that is configured to receive a pair of unfolded shoes, where the interior portion further includes the storage pocket of the collapsible tote bag. The method further comprises storing a pair of unfolded shoes in the collapsible tote bag when the collapsible tote bag is in the unfolded state.

Still another aspect of the present disclosure provides a method for carrying footwear. The method comprises removing a pair of shoes (e.g., unfoldable shoes) from a collapsible tote bag when the collapsible tote bag is in an unfolded state, the unfolded state characterized by an interior portion that is configured to contain the pair of unfolded shoes, where the interior portion further includes the storage pocket of the tote bag. The method further comprises folding the collapsible tote bag to a folded state, where the folded state of the collapsible tote bag is characterized by being completely contained within the storage pocket. The method further comprises placing the collapsible tote bag into a side pocket on an exterior of a drawstring pouch, when the collapsible tote bag is in the folded state. The method further comprises inserting a pair of folded shoes into an interior of the drawstring pouch when the drawstring pouch is in an undrawn state, where the undrawn state is characterized by an opening at the top of the drawstring pouch that is dimensioned and configured for receiving the pair of folded shoes into an interior of the drawstring pouch. The method further comprises pulling on a drawstring arranged on the upper portion of the drawstring pouch thereby sealing off the opening and concealing the pair of folded shoes.

BRIEF DESCRIPTION OF THE DRAWINGS

Like reference numerals refer to corresponding parts throughout the several views of the drawings.

DETAILED DESCRIPTION

Reference is first made to FIGS. 12 through 17 which depict an exemplary apparatus in accordance with the present disclosure. Subsequently, reference is made to FIGS. 1 through 11 which depict one type of foldable shoe (FIGS. 1-9, and 11) that may be stored in the exemplary apparatus, as well as a box (FIG. 10) in which the exemplary apparatus may be placed.

Figure 12:
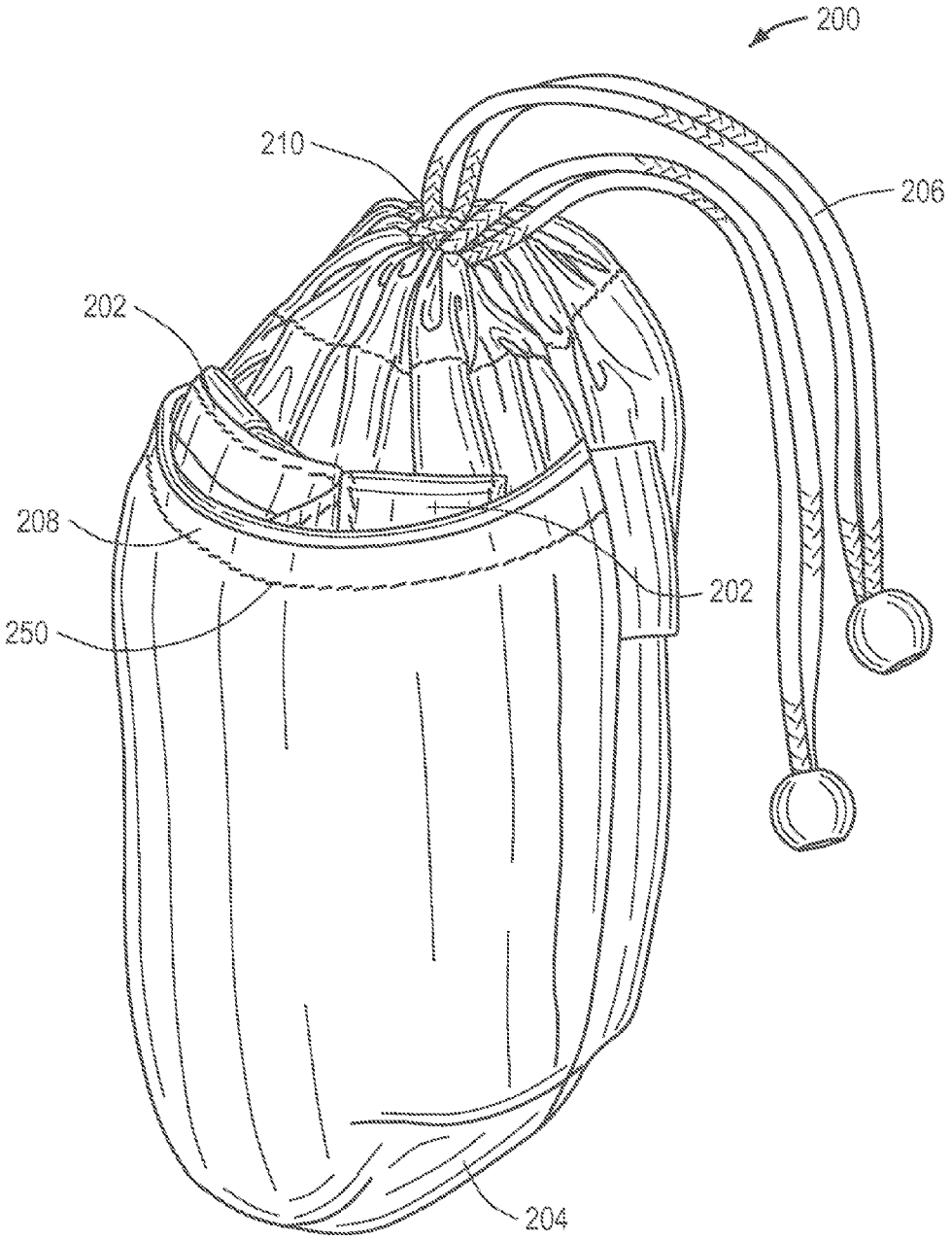
FIG. 12 is a perspective view of a drawstring pouch in accordance with an embodiment of the present disclosure, in which the drawstring pouch is in a drawn state, the drawn state characterized by a drawstring arranged on the upper portion of the drawstring pouch that seals off an opening, thereby concealing the interior of the drawstring pouch, the drawstring pouch further including a side pocket that contains a collapsible tote bag in a folded state.

Referring to FIG. 12, provided is a drawstring pouch 200. In some embodiments the drawstring pouch 200 is made of stretch nylon, polyester or similar material. Such material adds functionality by safely and cleanly storing the foldable footwear and related items. In some embodiments, the drawstring pouch 200 compresses the footwear in their folded configuration for minimal size when stored or transported. In some embodiments, a rounded edge 204 on the bottom of the drawstring pouch 200 further decreases volume and increases compression. In some embodiments, the drawstring pouch 200 is sized just smaller than the footwear to minimize bulk. A drawstring 206 around the opening of the pouch further aids compression, and seals dirty shoes from purse or pocket contents. A side pocket 208 located on one side of the drawstring pouch 200 allows for compressed storage of a collapsible tote bag 202 and/or other items. Examples of other items that may be stored in the side pocket 208 include, but are not limited to, personal effects (e.g., lipstick, comb, brush, makeup, and perfume), wallets, cameras, keys, identification, etc.

Figure 16:
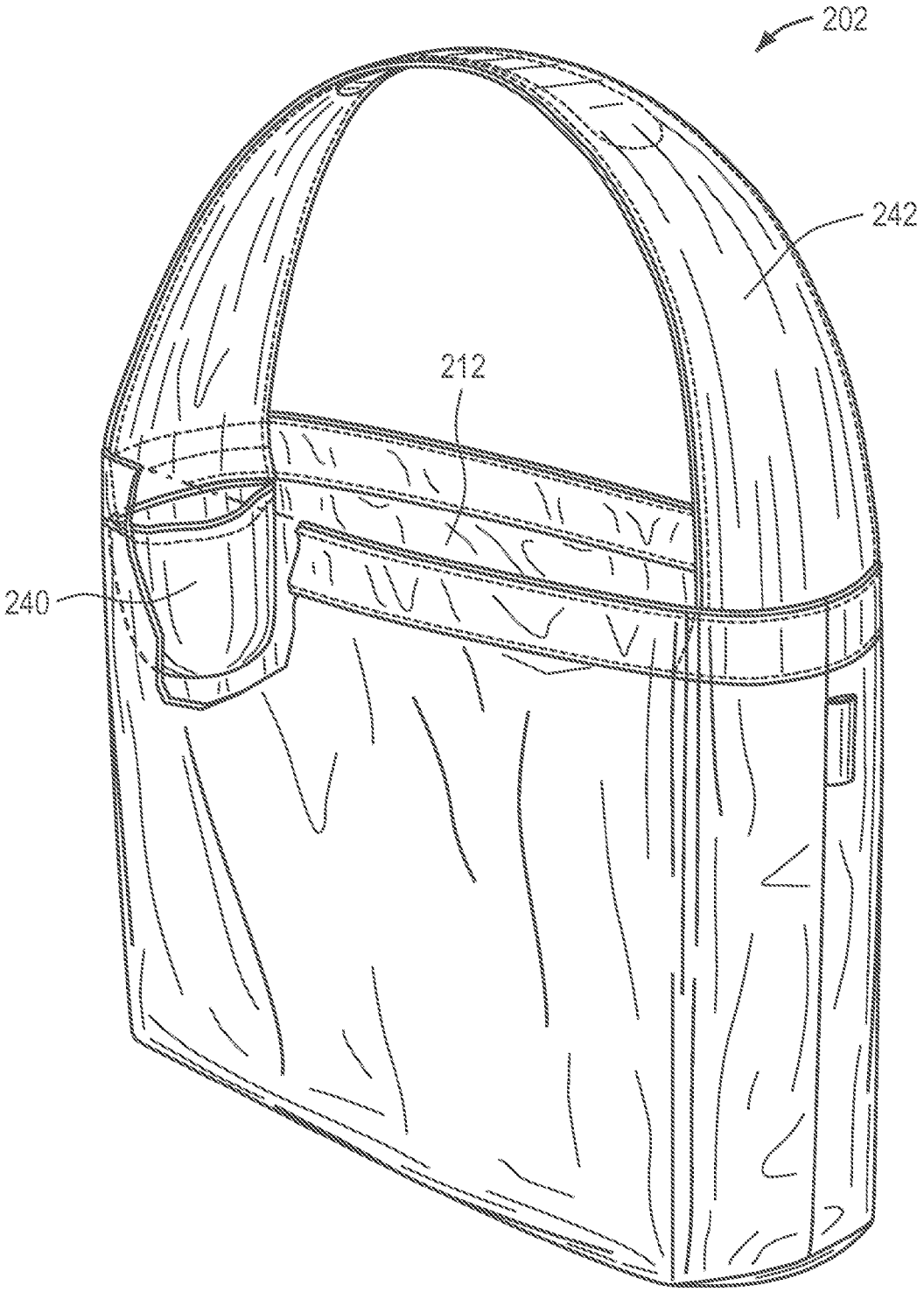
FIG. 16 is a perspective view of the collapsible tote bag in the unfolded state, where the unfolded state is characterized by an interior portion that is configured to receive a pair of unfolded shoes, the interior portion further including a storage pocket.

Referring to FIG. 16, a lightweight, durable, reusable, self-contained collapsible tote bag 202 with a handle 242 that may be folded and compressed, and then stored in the side pocket 208 of the drawstring pouch 200, adds utility to the foldable shoe system. When desired, the collapsible tote bag 202 expands to carry an alternate pair of shoes with sufficient volume for additional items. It will be appreciated that the tote bag 202 may have more than one handle.

Figure 13:
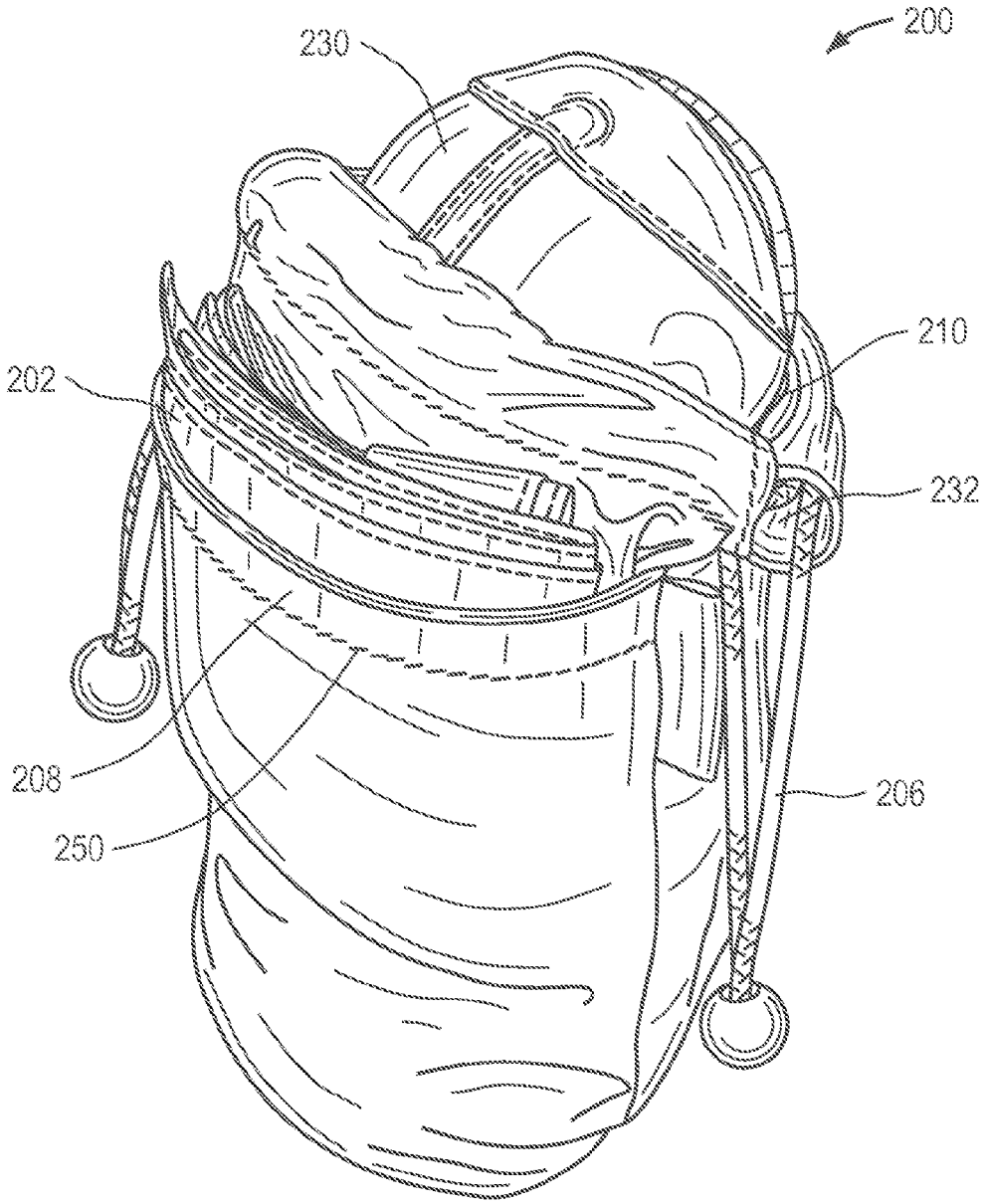
FIG. 13 is a perspective view of the drawstring pouch in an undrawn state, in which the drawstring pouch is characterized by the opening at the top of the drawstring pouch that is now dimensioned and configured for receiving a pair of foldable shoes in an interior of the drawstring pouch, the drawstring pouch further including a side pocket that contains a collapsible tote bag in a folded state.

Now that an overview of the components of the apparatus for carrying foldable footwear, drawstring pouch 200 and collapsible tote bag 202, have been disclosed a more detailed description of the apparatus and methods for using same will be detailed. Referring to FIGS. 12 through 17, an apparatus for carrying foldable footwear is collectively disclosed. The apparatus comprises a drawstring pouch 200 having a side pocket 208. The drawstring pouch 200 is reversibly configured to adjust between (i) an undrawn state as depicted in FIG. 13 and (ii) a drawn state as depicted in FIG. 12. When in the undrawn state (FIG. 13), the drawstring pouch 200 is characterized by an opening 210 at the top of the drawstring pouch 200 that is dimensioned and configured for receiving a pair of foldable shoes in an interior of the drawstring pouch. When in the drawn state (FIG. 12), the drawstring pouch is characterized by a drawstring 206 arranged on the upper portion of the pouch that seals off the opening 210, thereby concealing the interior of the drawstring pouch.

Referring to FIG. 13, advantageously, a seam that holds the drawstring pouch 200 together does not come up all the way to the rim of opening 210, thereby leaving a seam opening 232. This is advantageous because it allows for the drawstring pouch 200 to be dimensioned smaller. Indeed, in typical embodiments, when the drawstring pouch 200 does not contain a pair of shoes, it is in fact smaller than the size of a pair of shoes. Using FIG. 13 as a reference for width and height, in exemplary embodiments, the drawstring pouch has a width of 4.25 inches or less, 4.00 inches or less, or 3.75 inches or less. In exemplary embodiments, the drawstring pouch has a maximum height of 6.5 inches or less, 6.25 inches or less, 6.00 inches or less, 5.75 inches or less, or 5.50 inches or less. In typical embodiments drawstring pouch 200 is made out of a two-way stretch material and is capable of self-folding into a shape that minimizes volume (e.g., an approximately spherical shape). In some embodiments, the stitching 250 of the drawstring pouch facilitates this stretching (e.g., using a zigzag stitching). In some embodiments, a stretch thread material is used in such stitching.

A collapsible tote bag 202 (FIG. 16) is removably inserted in the side pocket 208 (FIG. 12) of the drawstring pouch. The collapsible tote bag 202 is configured to reversibly convert between (i) an unfolded state (FIG. 16) and (ii) a folded state. When in the unfolded state, the collapsible tote bag 202 is characterized by an interior portion 212 (FIG. 17) that is configured to receive a pair of shoes 230 (e.g., conventional unfoldable shoes). The interior portion further includes a storage pocket 240. When in the folded state, the collapsible tote bag 202 is characterized by being completely contained within this storage pocket 240. In typical embodiments storage pocket 240 is made out a two-way stretch material that compresses the tote bag when in the folded state. In some embodiments, the stitching of the storage pocket 240 facilitates the stretching of the stretch material (e.g., using zigzag stitching). In some embodiments, a stretch thread material is used in such stitching.

Figure 14:
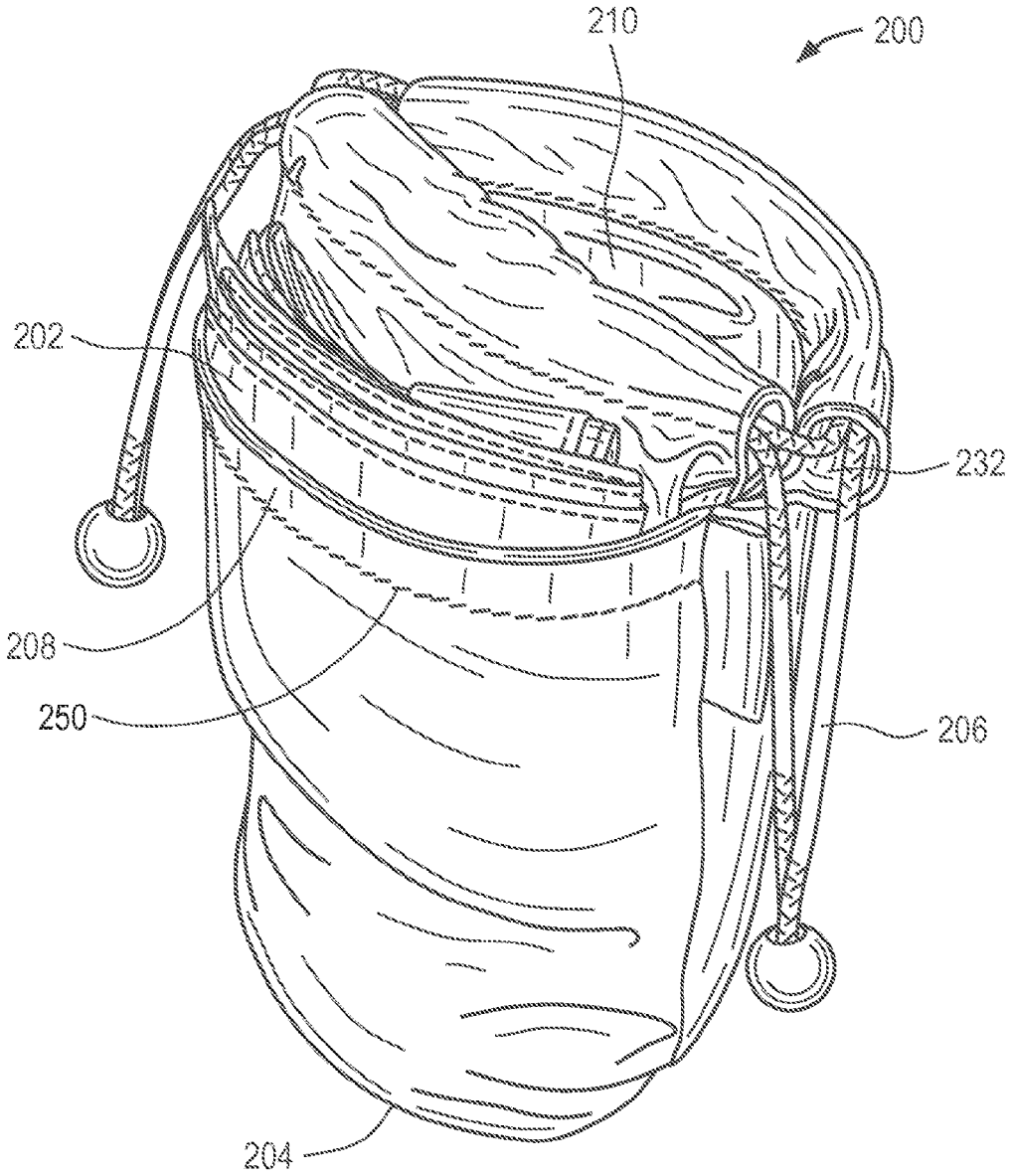
FIG. 14 is a perspective view of the drawstring pouch in an undrawn state with the pair of foldable shoes removed, the drawstring pouch further including a side pocket that contains a collapsible tote bag in a folded state.
Figure 15:
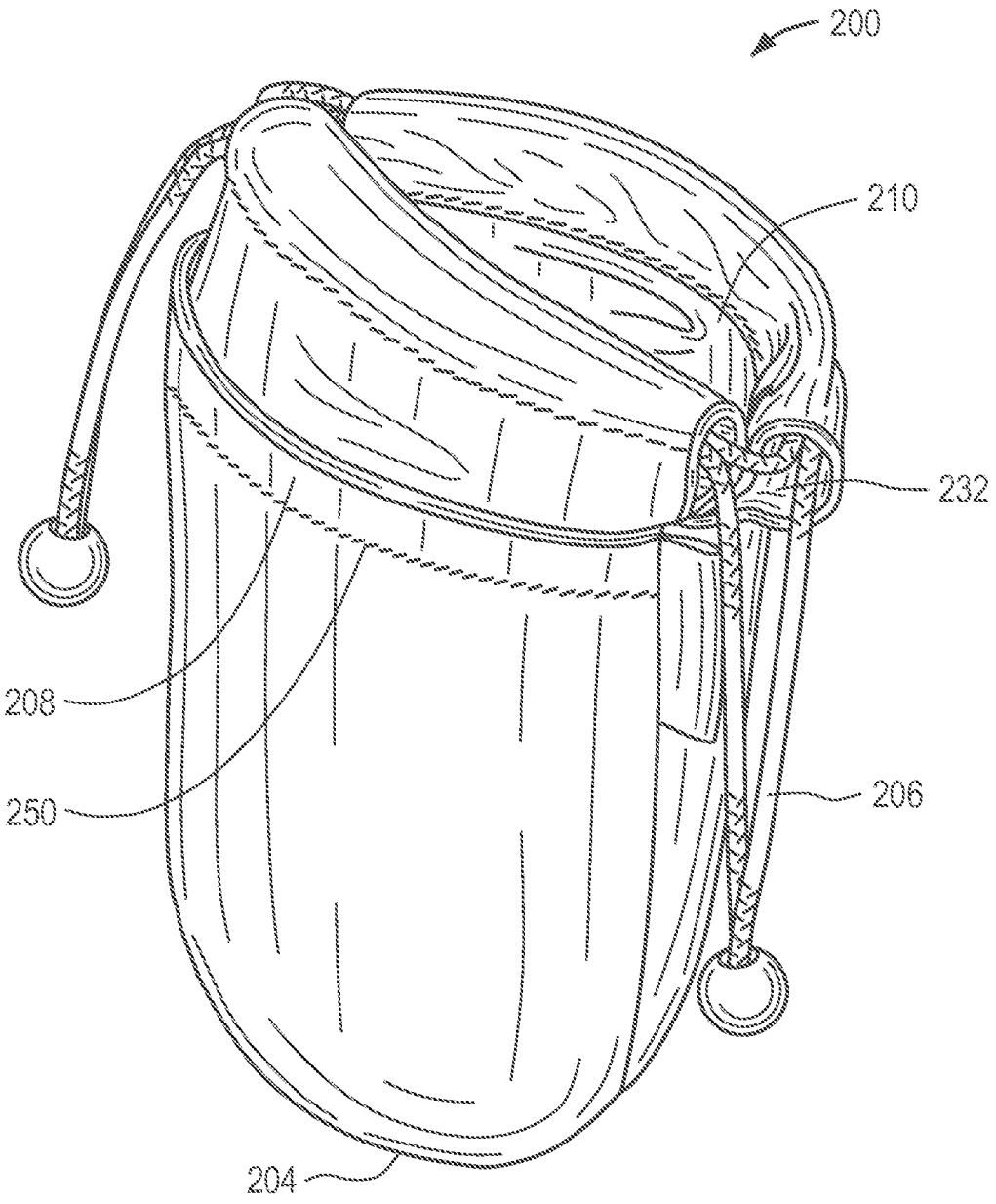
FIG. 15 is a perspective view of the drawstring pouch in an undrawn state with the pair of foldable shoes removed and the collapsible tote bag removed.
Figure 17:
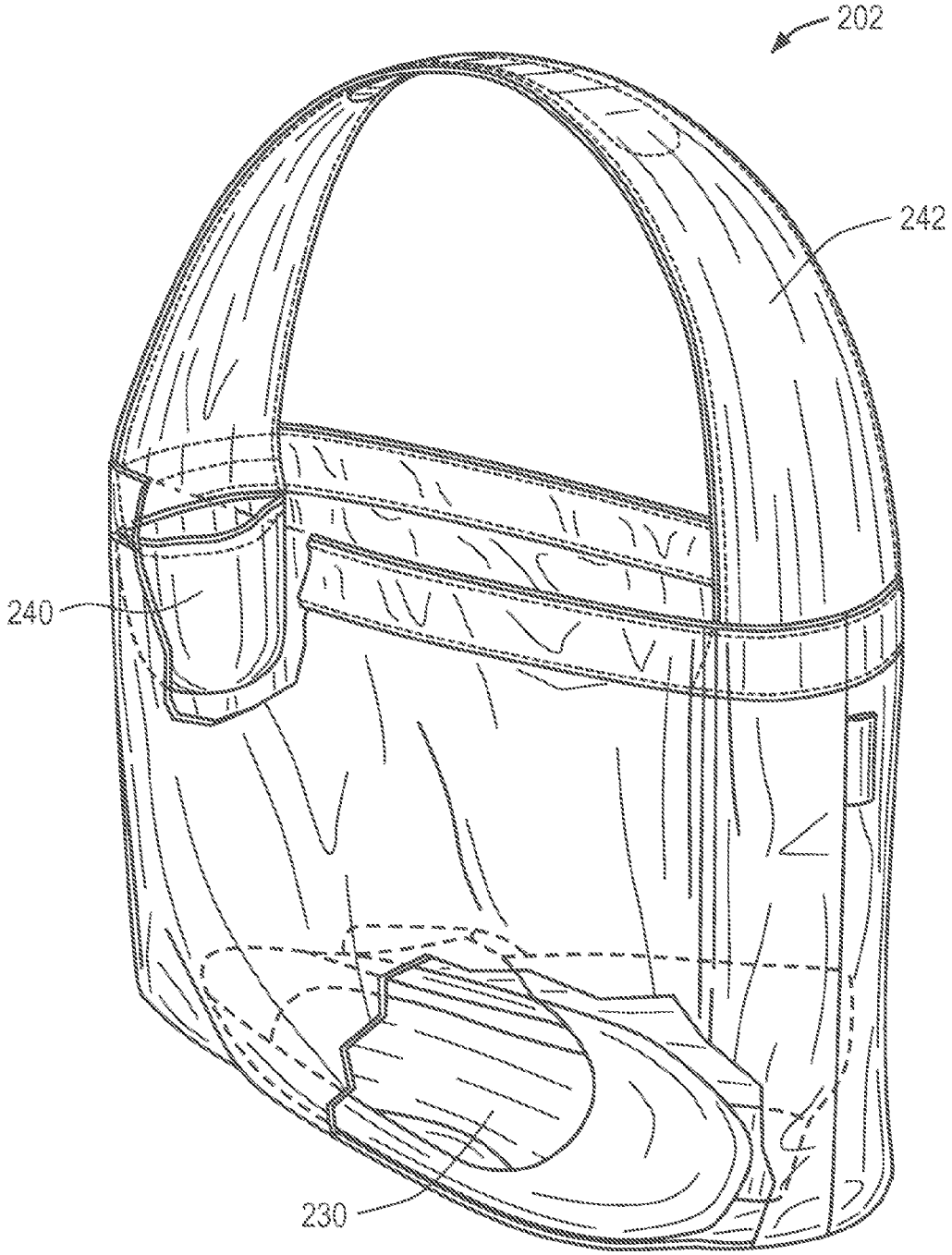
FIG. 17 is a perspective view of the collapsible tote bag in the unfolded state, with a pair of single sole (nonfoldable) women's shoes inside the tote bag.

Now that a more detailed disclosure of the apparatus for carrying foldable shoes has been disclosed, a method for carrying foldable footwear is described. In the method, a drawstring pouch 200 having a side pocket 208 is obtained (FIG. 12). The drawstring pouch 200 is in a drawn state that is characterized by a drawstring 206 arranged on an upper portion of the drawstring pouch 200, the drawstring 206 sealing off an opening 210 at the top of the drawstring pouch 200 thereby concealing an interior of the drawstring pouch. The method further comprises pulling on the upper portion of the drawstring pouch 200 thereby releasing the drawstring 206 and exposing the opening 210 and shoes 230 located in the interior of the drawstring pouch 200 (FIG. 13). The method further comprises removing a pair of folded shoes from the interior of the drawstring pouch when the opening is exposed (FIG. 14). The method further comprises removing a collapsible tote bag 202 from the side pocket 208 on an exterior of the drawstring pouch (FIG. 15). Here, the collapsible tote bag 202 is in a folded state in which the collapsible tote bag is completely contained within a storage pocket 240 of the collapsible tote bag. The method further comprises unfolding the collapsible tote bag 202 to an unfolded state, the unfolded state characterized by an interior portion 212 that is configured to receive a pair of unfolded shoes, where the interior portion further includes the storage pocket 240 of the collapsible tote bag (FIG. 16). Finally, the method further comprises storing a pair of unfolded shoes in the collapsible tote bag 202 when the collapsible tote bag is in the unfolded state (FIG. 17).

Reverse methods are, of course, within the scope of the present disclosure. In one such reverse method, a pair of unfolded shoes are removed from a collapsible tote bag 202 when the collapsible tote bag 202 is in an unfolded state, the unfolded state characterized by an interior portion that is configured to contain the pair of unfolded shoes, where the interior portion further includes the storage pocket 240 of the tote bag 202. The collapsible tote bag is then folded into a folded state, where the folded state of the collapsible tote bag 202 is characterized by being completely contained within the storage pocket 240. The collapsible tote bag 202 is then placed into a side pocket 208 on an exterior of a drawstring pouch 200, when the collapsible tote bag is in the folded state (FIG. 14). A pair of folded shoes is inserted into an interior of the drawstring pouch 200 when the drawstring pouch is in an undrawn state, where the undrawn state is characterized by an opening 210 at the top of the drawstring pouch 200 that is dimensioned and configured for receiving the pair of folded shoes into an interior of the drawstring pouch (FIG. 13). Then a drawstring 206 arranged on the upper portion of the drawstring pouch is pulled thereby sealing off the opening and concealing the pair of folded shoes (FIG. 12).

In any of aforementioned embodiments, the tote bag 202 and/or the drawstring pouch 200 can be made out of a synthetic fabric. In some embodiments, the tote bag 202 and/or the drawstring pouch 200 are made out of a fabric comprising rayon, acetate, nylon, modacrylic, olefin, acrylic, polyester, lycra, or carbon fiber.

FIGS. 1 through 5 respectively provide perspective, side, top, front and back views of a shoe that may be stored in the drawstring pouch 200 in accordance with the present disclosure. From the perspective and side views of FIGS. 1 and 2, and when worn, the shoe appears no different from a conventional rigid sole shoe. Yet the shoe affords flexibility in design, foldability, and comfort without dressing down the wearer's outfit. In some embodiments, a cushion insert absorbs impact to the foot from walking on hard surfaces. An elastic restriction 60 runs around the top of the upper 2 to grip the foot and form a snug fit on feet of various sizes and shapes. However, the elastic restriction 60 is designed to not encircle the entire foot, by stopping short in the back where it would otherwise uncomfortably grip the Achilles tendon area. Instead, an Achilles cushion 56 is embedded in the upper fold that would otherwise surround the elastic restriction 60 to increase comfort.

Figure 6:
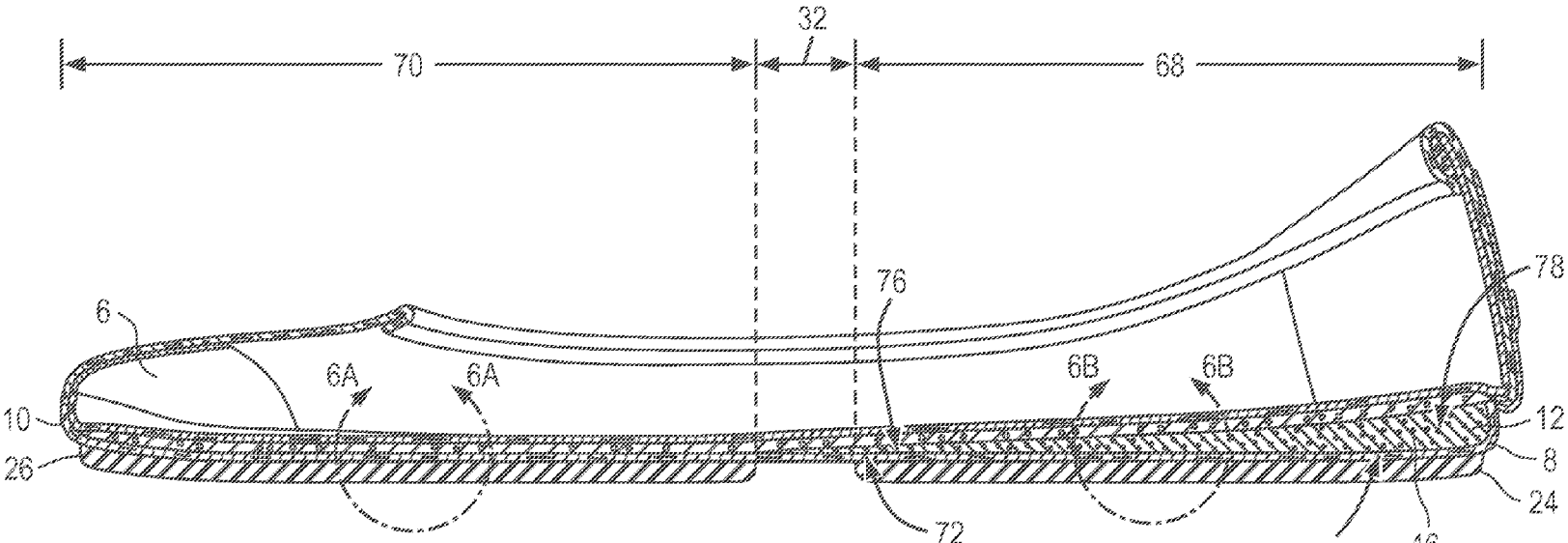
FIG. 6 is a cross-sectional side view of a shoe in accordance with an aspect of the disclosure in which the shoe is in an extended state.

Referring to FIG. 6, a flexible insole 30 provides added comfort without compromising portability, and may be fixed or removable. Optionally, the flexible insole 30 provides arch support. The shoe further comprises a foam inlay 44 that is affixed by glue to the insole 30. In some embodiments, a flexible arch support provides added comfort without compromising portability. The flexible arch support does not restrict folding of the shoe, and may be fixed or removable.

Continuing to refer to FIG. 6, the shoe comprises three uniquely shaped elements: a midsole 8, a heel outsole patch 24, and a toe outsole patch 26. In some embodiments, the midsole 8 is made of a flexible but durable material, such as high quality leather. In some embodiments, the heel outsole patch 24 and toe outsole patch 26 are constructed from all weather, non-skid material. In typical embodiments, the heel outsole patch 24 and the toe outsole patch 26 are individually sewn to the midsole 8. Materials required for the necessary durability and safety of a full time shoe are too rigid to afford the necessary flexibility to be folded. Thus, in preferred embodiments, the heel outsole patch 24 and the toe outsole patch 26 are distinct, and individually stitched to the midsole 8 with a spacing 32 between them for the shoe to be folded. The size and shape of the heel outsole patch 24 and the toe outsole patch 26 are designed to optimally balance durability, comfort, and practicality, with compact size and minimal weight. The shape of the heel outsole patch 24 and the toe outsole patch 26 maximize protection for the foot in a space efficient manner. In some embodiments, the contours of the heel outsole patch 24 and the toe outsole patch 26 are sloped to provide attractive additional height when worn, and increase the clearance between the midsole 8 and the ground when worn. In such embodiments, the slope is designed so that when two shoes are stacked, large meets small so as to significantly reduce the combined thickness of the compressed pair for increased portability.

The upper 2 of the shoe is made of a high quality flexible but durable material designed to withstand repeated folding at the center of the shoe, as well as long periods of storage in the folded position. Such materials reduce or eliminate cracking at the surface of the joint, and damage from contact with surfaces. The upper 2 is constructed and stitched in a manner to wrap around the top and sides of the foot. The specific proportion of upper to outsole also allows the soft upper 2 to mold to wide and narrow feet, molding to the unique shape of each wearer's foot, and adding comfort and style benefits. The proportion also reduces the bulk of the shoes in the folded state for storage and portability. A rounded toe cavity 6 and flexible wraparound upper design increases commercial appeal by reducing or eliminating the need for costly half-size and/or variable width inventory, while maintaining a durable and comfortable design. The design allows great flexibility for fashionable elements via the upper such as distinctive colors, textures and ornamentation. When worn, the shoe appears no different from conventional fixed sole footwear, adding style and the ability to be worn with more formal attire.

The disclosed foldable shoe design allows for footwear to be worn in a normal manner, consistent with conventional rigid sole products, and suitable for various surfaces, weather, fashions, etc. When storage or portability is desired, the shoes are folded manually at approximately their midpoint, thus reducing their length in half. In their folded configuration, the shoes can be stacked and placed in the compacting pouch for maximum compression and portability. Once stowed in the pouch, the pair requires roughly the space of a wallet, and may be carried in a purse or pocket.

Figure 7:
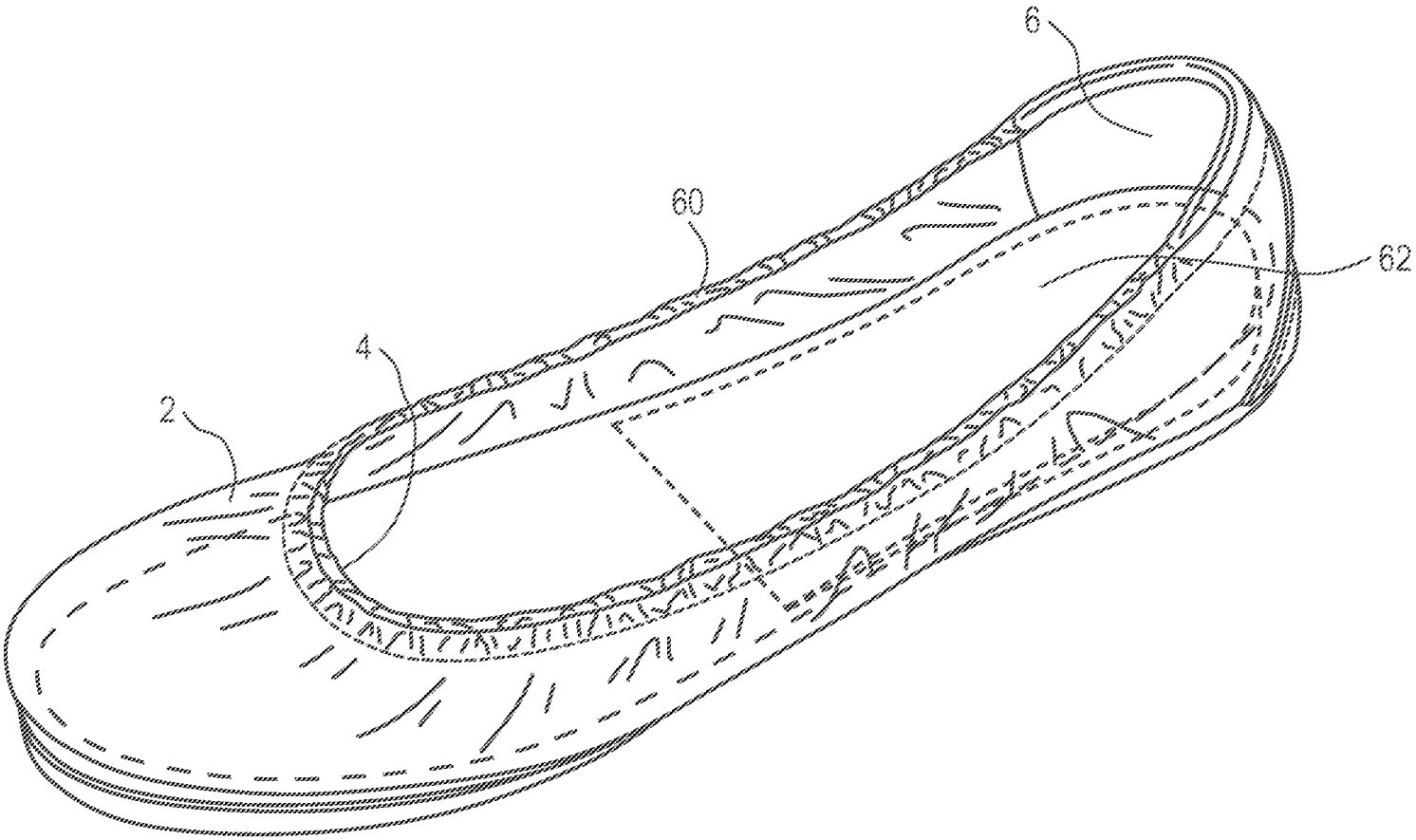
FIG. 7 is a perspective view of a shoe in accordance with an aspect of the disclosure showing a cushion insert in which the shoe is in an extended state.
Figure 8:
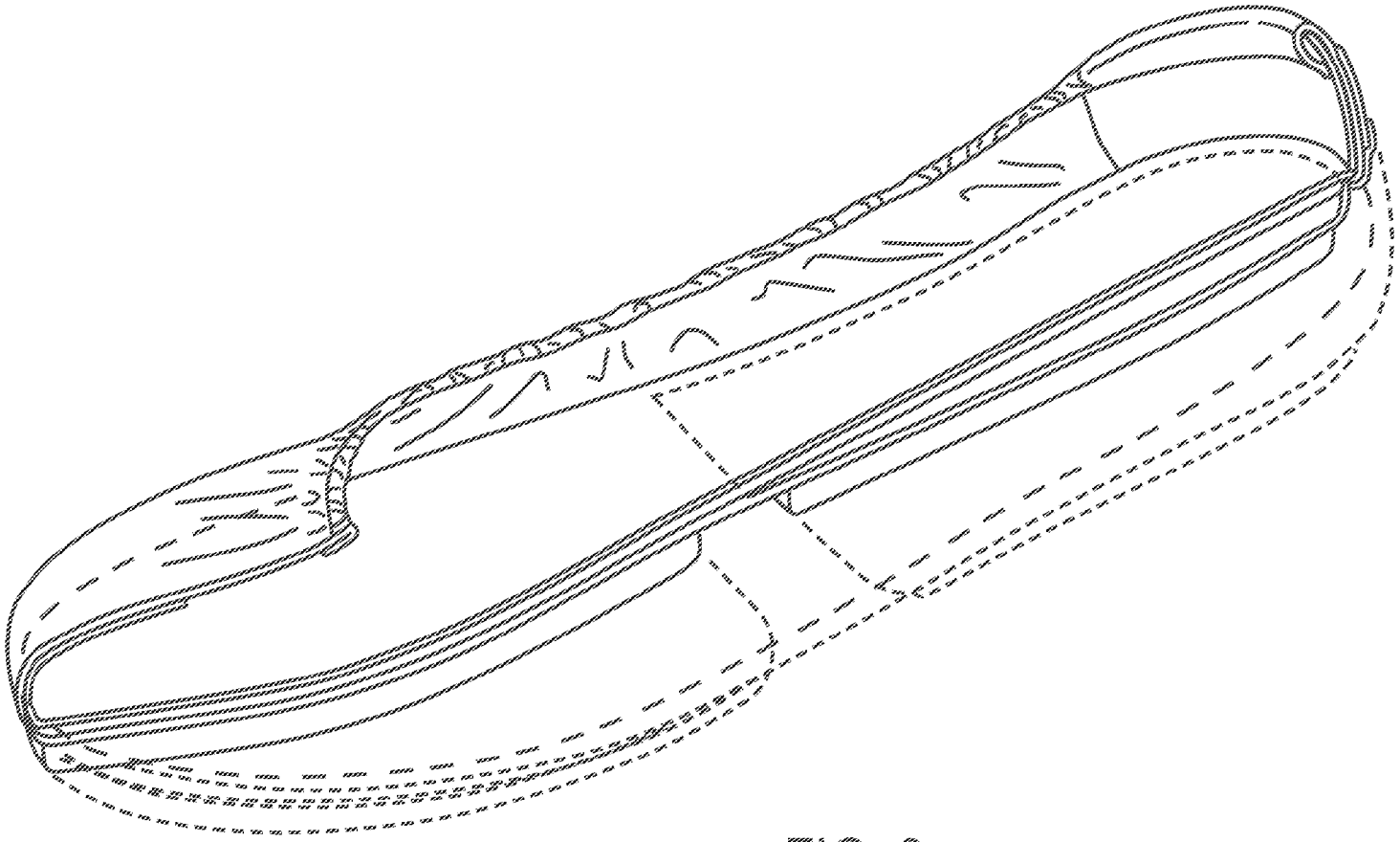
FIG. 8 is a cutaway perspective view of a shoe in accordance with an aspect of the disclosure in which the shoe is in an extended state.

Now that an overview of the shoe has been disclosed, specific features and various embodiments of the disclosed shoes will now be described. Referring to FIG. 7, illustrated is a shoe in accordance with the present disclosure. The shoe comprises an upper 2. The upper 2 forms an interior portion 62 for receiving a foot of a woman. The interior portion includes a toe cavity 4 and a heel cavity 6.

Figure 9:
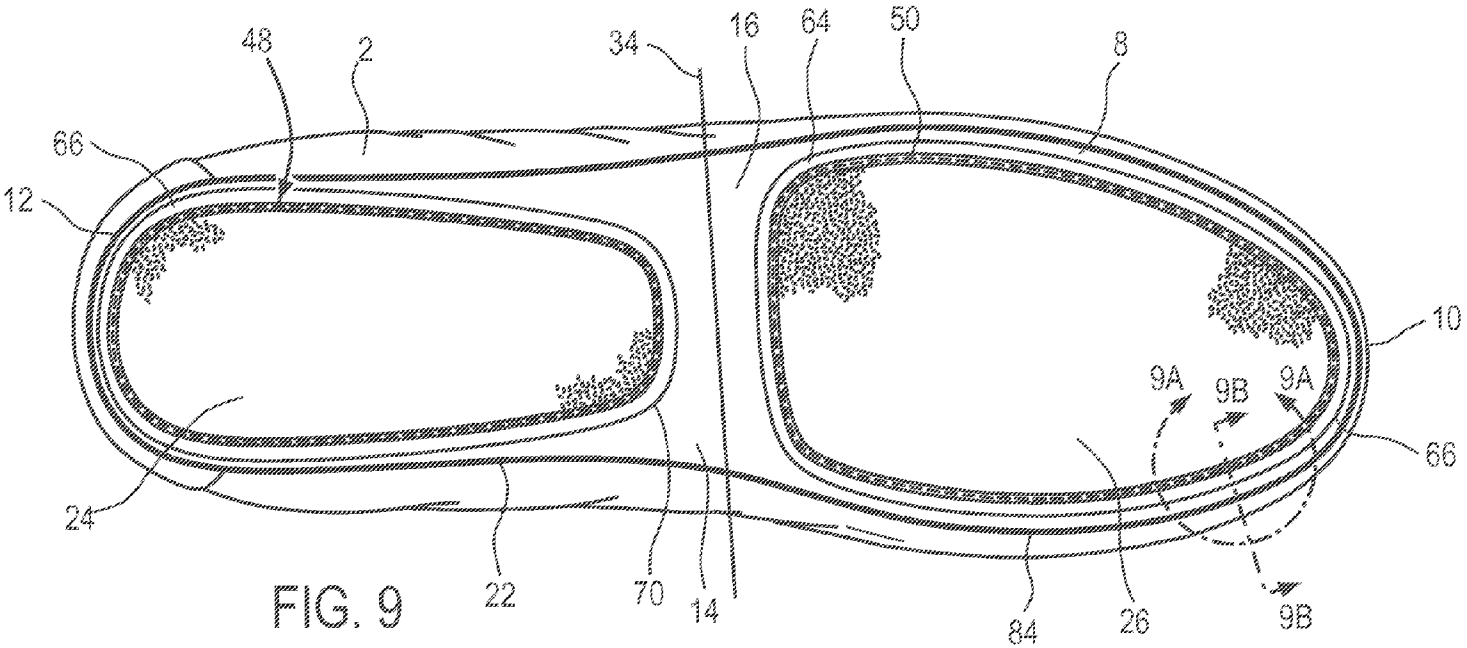
FIG. 9 is a bottom view of a shoe in accordance with an aspect of the disclosure in which the shoe is in an extended state.
Figure 9B:
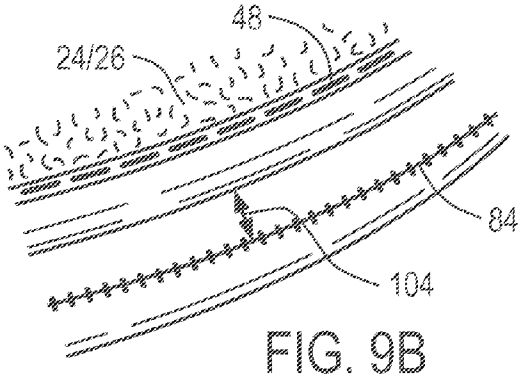
FIG. 9B is an inset cross-sectional view of FIG. 9B, taken about line 9B-9B of FIG. 9.

Referring to FIG. 9, the shoe further comprises a midsole 8. The midsole 8 has (i) a toe end 10, (ii) a heel end 12, (iii) an inner side 14 and (iv) an outer side 16. A perimeter of the midsole 8 is stitched to the upper 2. The stitching of the midsole 8 to the upper 2 thereby forms a bottom to the interior portion 62 that is bounded by a first seam 22. A heel outsole patch 24 is stitched onto a heel portion of a first face of the midsole 8. A toe outsole patch 26 is stitched onto a toe portion of the first face of the midsole 8.

In typical embodiments, the heel outsole patch 24 and the toe outsole patch 26 are stitched onto the midsole before the midsole 8 has been stitched to the upper 2.

Referring to FIG. 6, there is a spacing 32 between (i) the heel outsole patch 24 stitched onto the heel portion of the first face of the midsole 8 and (ii) the toe outsole patch 26 stitched onto the toe portion of the first face of the midsole 8. The spacing 32 extends from the inner side 14 to the outer side 16 of the midsole 8 and occupies a position intermediate the toe end 10 and the heel end 12 of the midsole 8 thereby permitting the entire shoe to fold about an axis 34 in the spacing 32 running between the inner side 14 and the outer side 16. In some embodiments, the spacing is between ⅜ of an inch and ⅝ of an inch. In some embodiments, the spacing is about ⅝ of an inch. In taking these measurements, an "average" distance between the heel outsole patch 24 and the toe outsole patch 26 across the region bounded by the inner side 14 and the outer side 16 may be taken. For example, at several different points in the region bounded by the inner side 14 to the outer side 16, the distance between the edge of the heel outsole patch 24 and the edge of the toe outsole patch 26 may be measured and these measurements may be averaged together to determine the distance between the heel outsole patch 24 and the toe outsole patch 26.

Figure 11:
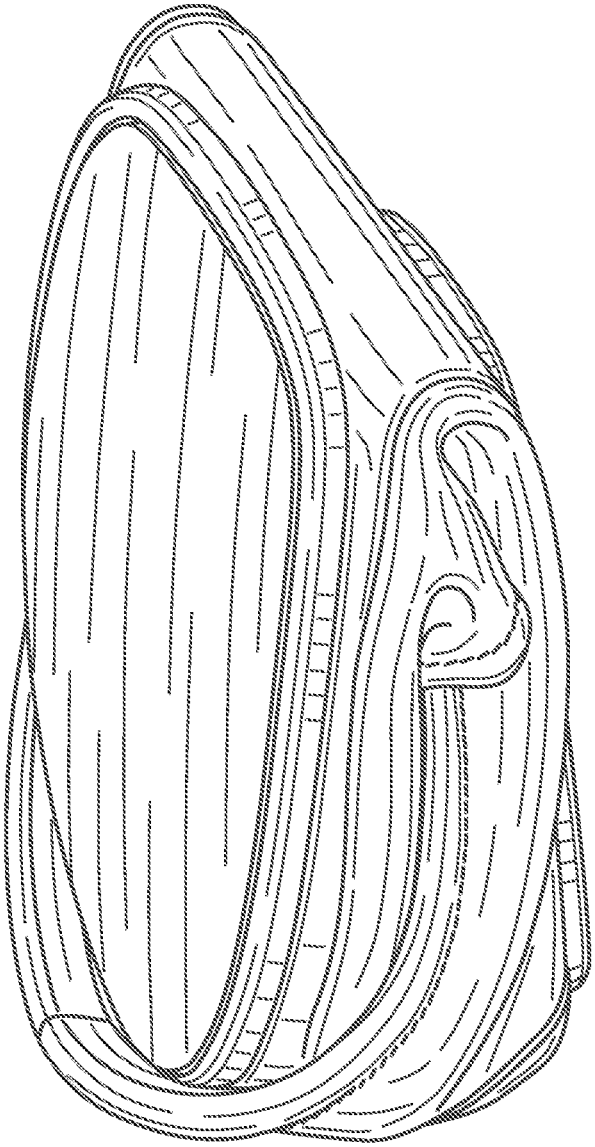
FIG. 11 is a perspective of a shoe in accordance with an aspect of the disclosure in which the shoe is in a folded state in which the shoe is bent about an axis such that a portion of an upper comprising a toe cavity is tucked into a heel cavity.

Continuing to refer to FIG. 6, the insole 30 is affixed by glue to the bottom of the interior portion. The shoe is configured to fold between (i) an extended state in which the heel outsole patch 24 and the toe outsole patch 26 are coplanar (FIGS. 1 through 9) and (ii) a folded state in which the shoe is bent about the axis 34 such that a portion of the upper 2 comprising the toe cavity 4 is tucked into the heel cavity 6 (FIG. 11).

In some embodiments, the insole 30 is not stitched to the upper 2. Thus, in such embodiments, the first seam 22, illustrated in FIG. 9, only joins the upper 2 and the midsole 8, not the insole 30. Referring to FIG. 9, this affords a substantial advantage because it allows a perimeter (edge) of the heel and toe outsole patches 24, 26 to be brought closer to the first seam 22 than in instances where the first seam binds the upper 2, midsole 8 and the insole 30 together, and allows for thicker heel and toe outsole patches, and more substantial (thicker, and more rigid) cushioning in the insole. This distance is illustrated as distance 104 in FIG. 9A. Accordingly, in embodiments where the first seam 22 only joins the upper 2 and the midsole 8, the edge of the back corner 64 of the toe outsole patch 26 is within ¼ of an inch of a portion of the first seam 22. This proximity to the seam 22, along with the thickness of the outsole patches, advantageously serves to protect the first seam 22 as well as the region of the midsole 8 in the spacing 32 from wear and tear. In some embodiments, an edge of front corner 66 of the toe outsole patch 26 is within ¼ of an inch of a portion of the first seam 22.

In typical embodiments, the distance 104 between the edge of the toe outsole pouch 26 and the first seam 22 is uniform. In some embodiments in which this distance 104 is uniform, (i) the edge of the back corner 64 and (ii) the edge of the front corner 66 of the toe outsole patch 26 are respectively within ⅝ of an inch, ⅜ of an inch, or ⅜ of an inch of a corresponding portion of the first seam 22.

In some embodiments, an edge of the back corner 68 of the heel outsole patch 24 is within 3/16 of an inch of a portion of the first seam 22. In some embodiments, an edge of the front corner 70 of the heel outsole patch 24 is between ¾ of an inch and ¾ of an inch of a portion of the first seam 22. In some embodiments, the distance 104 between the edge of the heel outsole pouch 24 and the first seam 22 is uniform. In some embodiments in which this distance 104 is uniform, (i) the edge of the back corner 68 and (ii) the edge of the front corner 70 of the heel outsole patch 24 are respectively within ⅝ of an inch, ⅜ of an inch, or ⅜ of an inch of a corresponding portion of the first seam 22. In some embodiments, the distance 104 between the edge of the heel outsole pouch 24 and the first seam 22 is not uniform. In some embodiments in which this distance 104 is not uniform, the edge of the back corner 68 of the heel outsole patch 26 is within ⅜ of an inch, or ⅜ of an inch of a corresponding portion of the first seam 22.

Such proximate distances 104, combined with the thickness of the rubber and rigidity of the cushioning enabled by the described method of assembly, facilitate the protection of the midsole 8 and the upper 2, thus ensuring the durability of the shoe while at the same time allowing for a foldable design that remains flexible and comfortable.

Figure 9A:
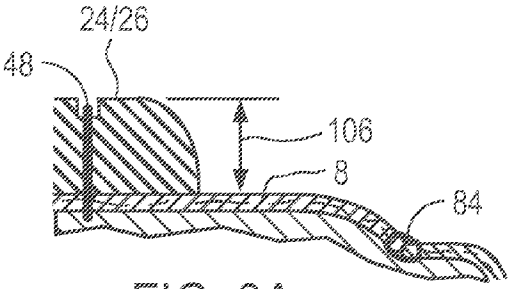
FIG. 9A is an inset perspective view taken about line 9A-9A of FIG. 9.

Referring to FIG. 9A, a unique and improved feature of the present shoes is the value of a durability coefficient. As used herein, the term "durability coefficient" is defined as the thickness 106 of an outsole patch divided by the distance 104 between the edge of the outsole patch and the first seam 22. In some embodiments, the distance 104 is 4 mm and the thickness 106 is also 4 mm and thus the durability coefficient is unity. In some embodiments, the distance 104 is 4 mm and the thickness 106 is 5 mm and thus the durability coefficient is 1.25. In some embodiments, the durability coefficient is between 0.8 and 1.5. In some embodiments, the durability coefficient is between 0.9 and 1.4. In some embodiments, the durability coefficient is between 1.0 and 1.3.

Figure 1:
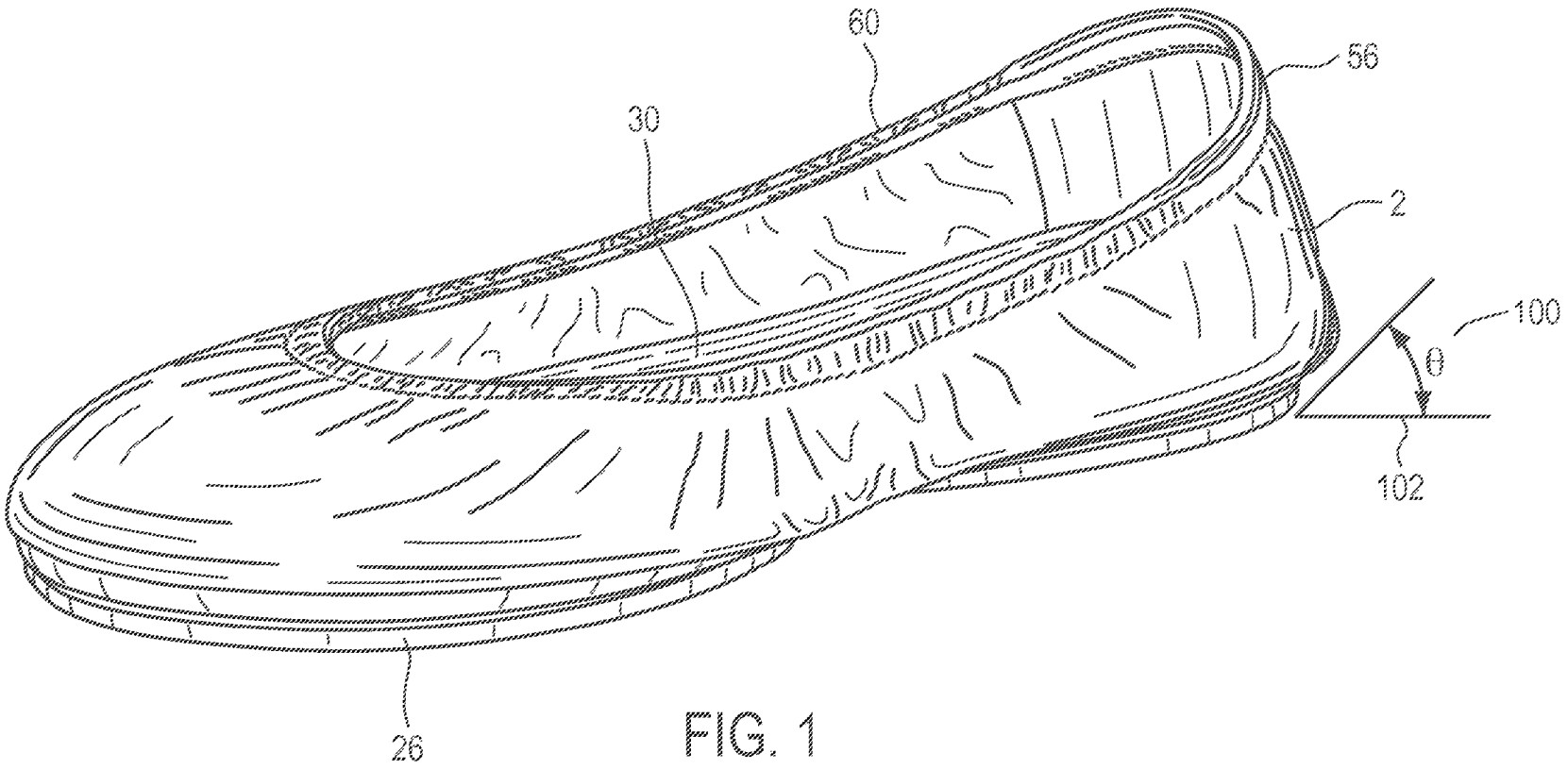
FIG. 1 is a perspective view of a shoe in accordance with an aspect of the disclosure in which the shoe is in an extended state.
Figure 2:
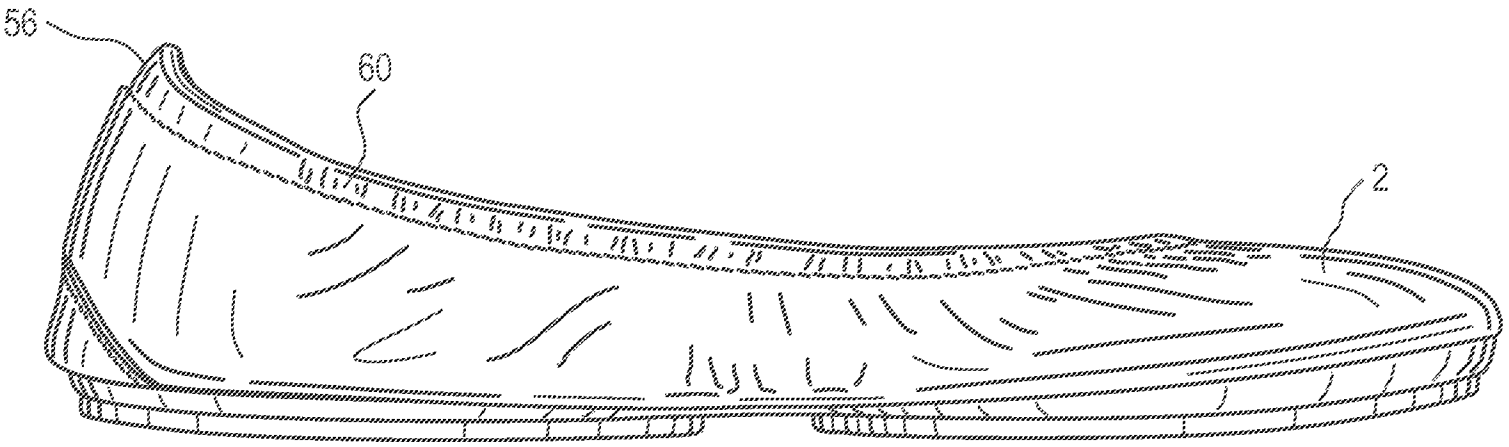
FIG. 2 is a side view of a shoe in accordance with an aspect of the disclosure in which the shoe is in an extended state.

In some embodiments, advantageously, the heel outsole patch 24 and the toe outsole patch 26 are each at least 3/32 of an inch thick. In some embodiments, advantageously, the heel outsole patch 24 and the toe outsole patch 26 are each at least 4/32 of an inch thick. In some embodiments, the heel outsole patch 24 and the toe outsole patch 26 are each at least 5/32 of an inch thick. In some embodiments, the heel outsole patch 24 and the toe outsole patch 26 are each at least 6/32 of an inch thick. In some embodiments, the heel outsole patch 24 and the toe outsole patch 26 are each at least 7/32 of an inch thick. In some embodiments, the heel outsole patch 24 and the toe outsole patch 26 are each at least 8/32 of an inch thick. Such thickness increases the spring constant of the soles, leading to greater support for the foot and increased durability of the shoe. Referring to FIG. 1, because of the thickness of the outsole patches, and their proximity to the edge, it is possible to view a side of the outsole patch at least at a 45 degree angle 100 from the horizontal 102 when the shoe is worn on a woman's foot when the woman is standing upright with respect to the horizontal. In some embodiments, it is possible to view a side of the outsole patch at least at a 50 degree angle, at least a 55 degree angle, or at least a 60 degree angle 100 from the horizontal 102 when the shoe is worn on a woman's foot when the woman is standing upright with respect to the horizontal. This visibility of the outsole patches is described herein solely to set forth a description of the dimensions and shapes of the disclosed shoes.

In some embodiments, the heel outsole patch 24 and the toe outsole patch 26 are each made out of an elastomer. Exemplary elastomers that may be used include but are not limited to, for example, natural rubber, vulcanized natural rubber, a butadiene-styrene copolymer such as GR-S, neoprene, nitrile rubbers, butyl, polysulfide rubbers, ethylene-propylene rubbers, polyurethane rubbers, and silicone rubbers as described in *Marks' Standard Handbook for Mechanical Engineers,* 1987, Avallone and Baumeister, eds., McGraw-Hill, New York, pp. 6-161 through 1-163, which is hereby incorporated herein by reference. In some embodiments the midsole 8 is made out of leather.

Figure 6B:
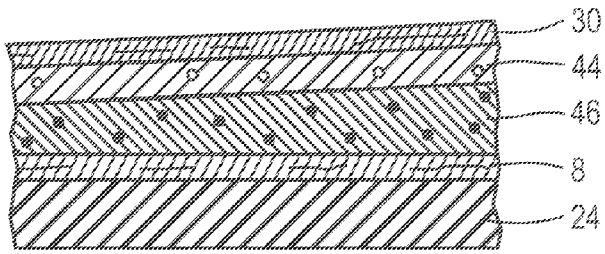
FIG. 6B is a cross-sectional view taken about region 6B-6B of FIG. 6.
Figure 6A:
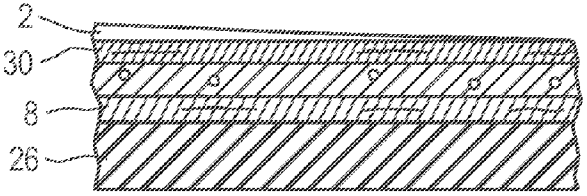
FIG. 6A is a cross-sectional view taken about region 6A-6A of FIG. 6.

Referring to FIGS. 6, 6A, and 6B, in some embodiments the shoe is characterized by a midsole 8. A heel outsole patch 24 and a toe outsole patch 26 are sewn onto a first face of the midsole 8. The midsole 8 comprises a second face having a heel portion 68 and a toe portion 70. In some embodiments, a cushion insert 46 is glued to the heel portion 68 of a second face of the midsole 8. The insert 46 absorbs impact to the foot when walking on hard surfaces. The insert 46 molds to the foot over time. A foam inlay 44 is glued to (i) the cushion insert 46 and (ii) the toe portion 70 of the second face of the midsole 8. Next an insole 30 is affixed by glue to the foam inlay 44. The cushion insert 46 is characterized by a first end 76 and a second end 78. The first end 76 of the cushion insert 46 is glued to a first part 72 of the heel portion 68 and the second end 78 of the cushion insert 46 is glued to a second part 74 of the heel portion 68. The first part 72 of the heel portion 68 is closer to the toe portion 70 of the second face of the midsole 8 than the second part 74 of the heel portion 68. In some embodiments, the first end 76 of the cushion insert 46 has a thickness that is less than the thickness of the second end 78 of the cushion insert 46. In some embodiments, the cushion insert 46 has a thickness that increases along the cushion insert 46 as a function of a distance away from the toe portion 70 of the second face of the midsole 8 so that a portion of the cushion insert that is closest to the toe portion 70 of the midsole is thinner than a portion of the cushion insert 46 that is farthest away from the toe portion 70 of the midsole 8. In some embodiments, the maximum thickness of the cushion insert 46 is 3 millimeters or more, 4 millimeters or more, 5 millimeters or more, 6 millimeters or more, 7 millimeters or more, or 8 millimeters or more. This advantageously serves to improve the support provided by the shoe, particularly at the heel, provides desired lift, and increases rigidity and thereby durability.

In addition to providing a graduated thickness to improve foot support, the cushion insert 46 is made out of a rigid material such as a rigid ethylene vinyl acetate or similar cushion material. In some embodiments, the cushion insert 46 has a Shore A hardness of between 45 and 70 or between 60 and 70. In some embodiments, the cushion insert 46 has a density of between 0.30 g/cm$^3$ and 0.5 g/cm$^3$, between 0.40 g/cm$^3$ and 0.5 g/cm$^3$, between 0.45 g/cm$^3$ and 0.5 g/cm$^3$, or between 0.50 g/cm$^3$ and 0.70 g/cm$^3$.

The thickness of the heel outsole patch 24 and the toe outsole patch 26 together with the materials used to make these patches, the proximity of these patches to the seam 22 and the ability to add the cushion insert, contributes to a greatly improved spring constant relative to known foldable shoes. In some embodiments, the overall spring constant of the shoe taken lengthwise in the heel portion 68 of the shoe (i.e., in the region of the heel outsole patch 24) is between 0.40 kilogram-force/inch and 0.70 kilogram-force/inch. In some embodiments, the overall spring constant of the shoe taken lengthwise in the heel portion 68 of the shoe is between 0.45 kilogram-force/inch and 0.65 kilogram-force/inch, or between 0.55 kilogram-force/inch and 0.65 kilogram-force/inch. In some embodiments, the overall spring constant of the shoe taken lengthwise in the heel portion 68 of the shoe is about 0.6 kilogram-force/inch. Referring to FIG. 6, to arrive at the spring constant measurement, the portions 68 and 70 are measured separately. For each region, with the shoe held in an upright position one end (i.e., one end of portion 68 or 70 going the long way and with shoe facing up as it would be worn) is anchored and then the other end of the portion 68 or 70 of the shoe being measured is forced down a set distance (e.g., 1 inch) and the force exerted by the pushed down end is then measured.

In some embodiments, the overall spring constant of the shoe taken lengthwise in the toe portion 70 of the shoe (i.e., in the region of the toe outsole patch 26) is between 0.40 kilogram-force/inch and 0.70 kilogram-force/inch. In some embodiments, the overall spring constant of the shoe taken lengthwise in the toe portion 70 of the shoe is between 0.45 kilogram-force/inch and 0.65 kilogram-force/inch or between 0.55 kilogram-force/inch and 0.65 kilogram-force/inch. In some embodiments, the overall spring constant of the shoe taken lengthwise in the toe portion 68 of the shoe is about 0.6 kilogram-force/inch.

Another advantageous feature of the shoes in accordance with some embodiments of the present disclosure are deep grooves in the heel outsole patch 24 and the toe outsole patch 26 that facilitate the stitching of the patches to the midsole 8 while at the same time protecting the stitching. The deep grooves 48 are enabled by the advantageous design in which thick outsole patches are employed that, at the same time, are proximate to the first seam 22 which attaches the upper 2 to the midsole 8. The deep grooves 48 protect the stitching that attaches the outsole patches to the midsole 9 from contact with the ground, which would cause the stitching to wear and thereby cause the outsole patches to become detached. These advantageous features are related. By only stitching the upper 2 to the midsole 8 to form the first seam, rather than further stitching insole 30 to the midsole 8, it is possible to both minimize distance 104 and increase thickness of the outsole patches 24/26 while still being able to stitch the midsole 8 to the upper 2 using conventional processes such as a sewing machine. Because distance 104 is minimized, it is possible to make the outsole patches 24/26 thicker (i.e., increase distance 106) without destabilizing foot support. Because the outsole patches 24/26 are thicker, it is possible to make the first groove 48 deeper thereby better protecting the stitching within the groove. Moreover, because the outsole patches are thicker, the shoe is firm and allows for use for longer periods of time and a greater spectrum of terrain (e.g., on asphalt, concrete, dirt roads, etc.) Referring to FIG. 9, one such advantageous embodiment has a first groove 48 having a depth of at least 3/64 of an inch that is formed proximate to a perimeter of the heel outsole patch 24. The heel outsole patch 24 is stitched onto the heel portion of the first face of the midsole 8 with a first thread that occupies the first groove 48. Further, a second groove 50 having a depth of at least 3/64 of an inch is formed proximate to a perimeter of the toe outsole patch 26. The toe outsole patch 26 is stitched onto the toe portion of the first face of the midsole 8 with a second thread that occupies the second groove 50. In some embodiments, the first groove 48 is about 3/32 of an inch. In some embodiments, the second groove 50 is about 3/32 of an inch.

Figure 5:
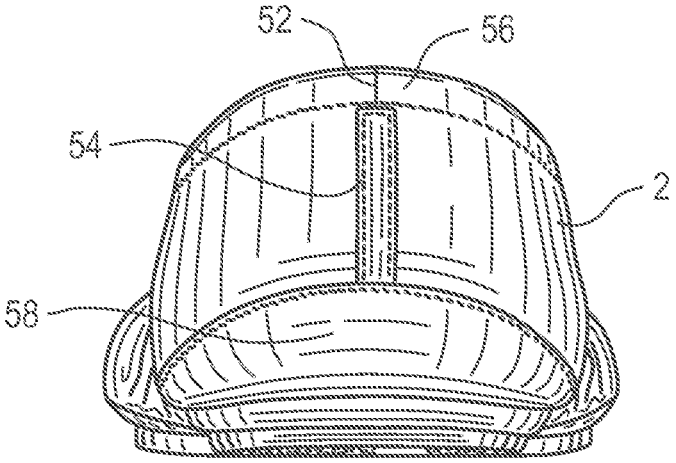
FIG. 5 is a rear view of a shoe in accordance with an aspect of the disclosure in which the shoe is in an extended state.

Referring to FIG. 5, the upper 2 is formed as a single piece having a first end and a second end, where the first end and the second end are united by a second seam 52 at the heel cavity. In some embodiments upper 2 is formed of two or more pieces.

Figure 3:
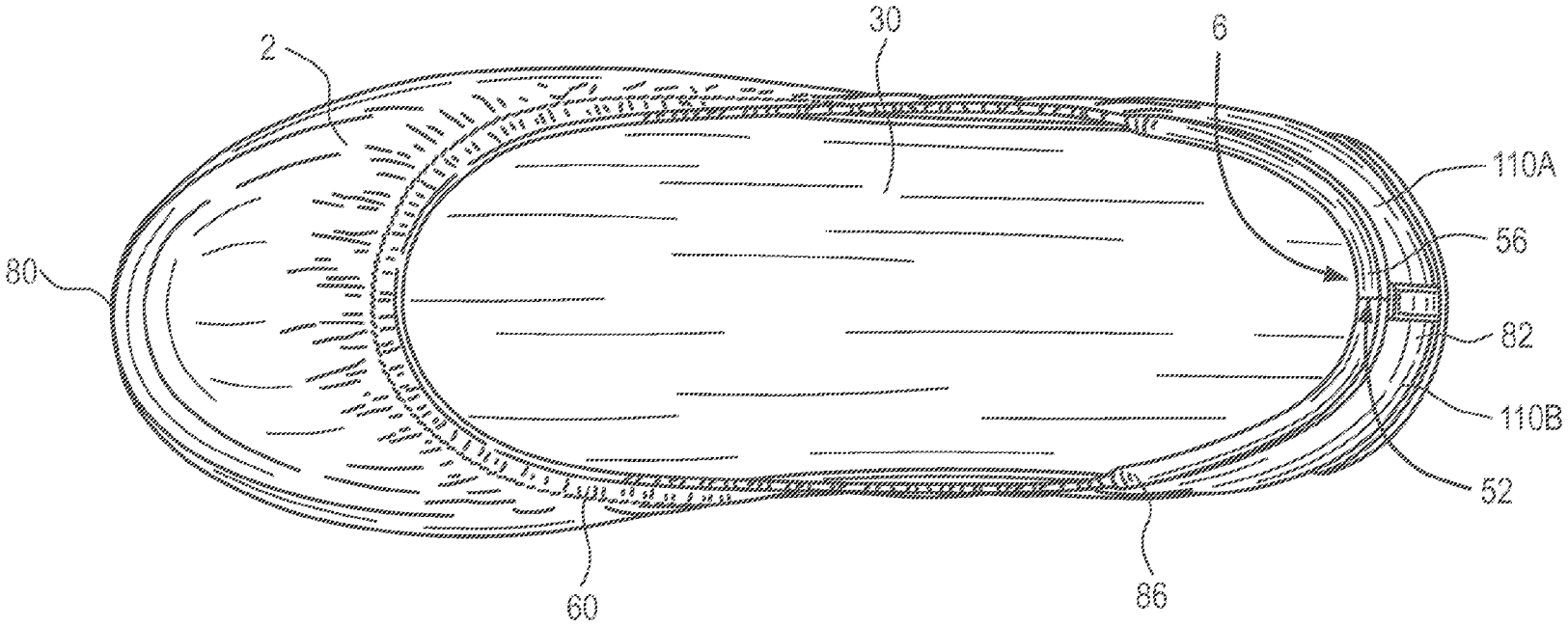
FIG. 3 is a top view of a shoe in accordance with an aspect of the disclosure in which the shoe is in an extended state.
Figure 4:
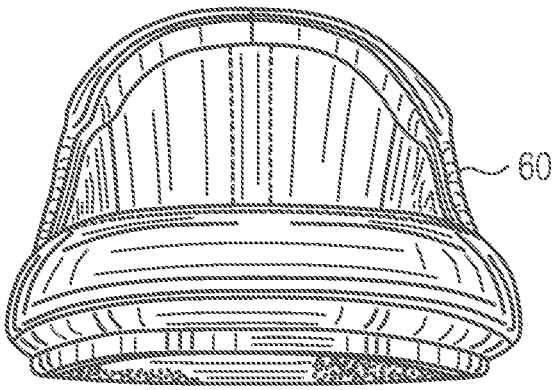
FIG. 4 is a front view of a shoe in accordance with an aspect of the disclosure in which the shoe is in an extended state.

Referring to FIGS. 3 and 9, in typical embodiments, the upper 2 is formed as a single piece having (i) a first end (80), (ii) a second end (82), (iii) a first edge (84) (visible in FIG. 9), and (iv) a second edge (86). In some embodiments, upper 2 is formed of two or more pieces sewn together. Referring to FIG. 3, in typical embodiments, upper 2 is a single piece having ends 110A and 110B. Of course, upper 2 may be formed by any number of pieces sewn together into a single piece having ends 110A and 110B. Regardless of whether upper originates as one or multiple pieces, ends 110A (first end) and 110B (second end) are united by a second seam 52 at the heel cavity 6 to complete the upper 2. Referring to FIG. 9, the first edge 84 of the upper 2 is stitched to the perimeter of the midsole 8 thereby forming the second seam 22 and the bottom to the interior portion of the shoe. Referring back to FIG. 3, a first portion of the second edge 86 is characterized by an elastic restriction 60, where the portion of the second edge does not extend to the heel cavity 6. In some embodiments, the second portion of the second edge 86 is characterized by an Achilles cushion 56 that provides an upper boundary to the heel cavity 6. Further, referring to FIG. 5, in some embodiments, a half-moon piece 58 covers a lower portion of the second seam 52 whereas a strip portion 54 covers an upper portion of the second seam 52.

Referring to FIG. 11, in some embodiments, the shoe is in a folded state. In this folded state, the shoes can be tucked into a stretch nylon or similar material compacting pouch (not shown), having a drawstring. This provides for the advantageous transport of the shoes in a clean and compact state, while compressed into a minimal size. In some embodiments, the pouch includes a side pocket 208 for holding a tote bag, where the tote bag is configured to accommodate a pair of women's shoes, or other items and personal effects. This allows for the possibility of carrying the shoes of the present disclosure in the pouch, while on the road, and switching to wearing the shoes of the present disclosure by storing unwanted previously worn shoes in the tote bag after it has been removed from the storage pocket 240 of the pouch, and expanded from its collapsed form.

Figure 10:
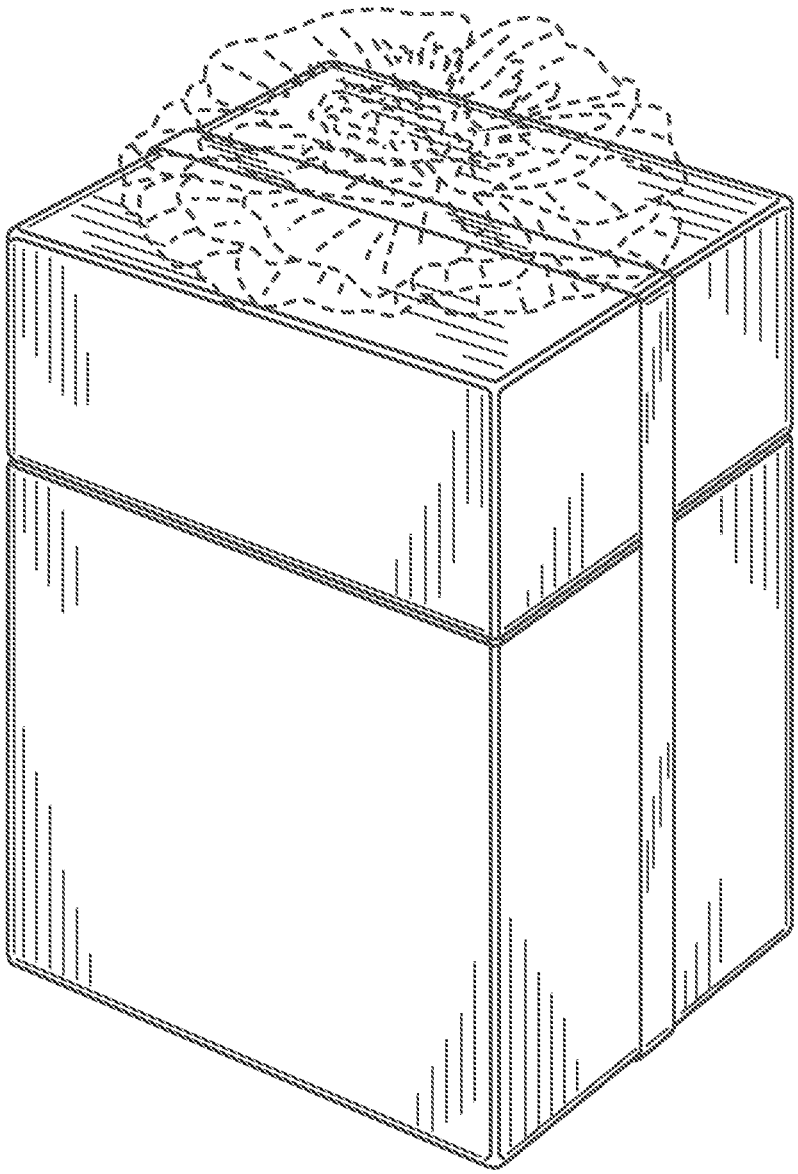
FIG. 10 is a compact box having a lid in which an apparatus of the present disclosure may be stored.

Advantageously, the shoes of the present disclosure tuck into a folded state so that they may be stored in a compact box having a lid. Such a compact box is illustrated in FIG. 10.

REFERENCES CITED AND ALTERNATIVE EMBODIMENTS

All references cited herein are incorporated herein by reference in their entirety and for all purposes to the same extent as if each individual publication or patent or patent application was specifically and individually indicated to be incorporated by reference in its entirety for all purposes.

Many modifications and variations of this invention can be made without departing from its spirit and scope, as will be apparent to those skilled in the art. The specific embodiments described herein are offered by way of example only. The embodiments were chosen and described in order to best explain the principles of the invention and its practical applications, to thereby enable others skilled in the art to best utilize the invention and various embodiments with various modifications as are suited to the particular use contemplated.

This disclosure extends to various footwear styles (in addition to the basic ballet flat/slipper depicted in the diagrams). For example: sandals, flip-flops, active and athletic shoes can be stored in the apparatus of the present disclosure. The invention is to be limited only by the terms of the appended claims, along with the full scope of equivalents to which such claims are entitled.

What is claimed:

1. An apparatus for carrying foldable footwear, the apparatus comprising:

(A) a drawstring pouch having a side pocket, wherein the drawstring pouch is reversibly configured to adjust between (i) an undrawn state and (ii) a drawn state, wherein the drawstring pouch:

when in the undrawn state, is characterized by an opening at the top of the drawstring pouch that is dimensioned and configured for receiving a pair of foldable shoes in an interior of the drawstring pouch, and when in the drawn state, is characterized by a drawstring arranged on the upper portion that seals off the opening, thereby concealing the interior of the drawstring pouch; and (B) a collapsible tote bag removably inserted in the side pocket, wherein the collapsible tote bag is configured to reversibly convert between (i) an unfolded state and (ii) a compressed folded state, wherein the collapsible tote bag:

when in the unfolded state, is characterized by an interior portion that is configured to receive a pair of unfolded shoes, wherein the interior portion further includes a storage pocket, and when in the folded state, is characterized by being completely compressed and contained within the storage pocket, wherein each shoe in the pair of foldable shoes comprises:

an upper, the upper forming an interior portion for receiving a foot of a person, the interior portion including a toe cavity and a heel cavity;

a midsole, the midsole having (i) a toe end, (ii) a heel end, (iii) an inner side, and (iv) an outer side, wherein a perimeter of the midsole is stitched to the upper thereby forming a bottom to the interior portion that is bounded by a first seam;

a heel outsole patch stitched onto a heel portion of a first face of the midsole;

a toe outsole patch stitched onto a toe portion of the first face of the midsole;

wherein the shoe is configured to fold between (i) an extended state wherein the heel outsole patch and the toe outsole patch are coplanar and (ii) a folded state in which the shoe is bent about an axis between the heel and toe outsole patch such that a portion of the upper comprising the toe cavity is tucked into the heel cavity; and wherein the pair of shoes is in the folded state when the pair of foldable shoes is received in the interior of the drawstring pouch.

2. The apparatus of claim 1 wherein there is a spacing between (i) the heel outsole patch stitched onto the heel portion of the first face of the midsole and (ii) the toe outsole patch stitched onto the toe portion of the first face of the midsole, the spacing extending from the inner side to the outer side and occupying a position intermediate the toe end and the heel end thereby permitting the entire shoe to fold about the axis.

3. The apparatus of claim 1 wherein the tote bag is made out of a synthetic fabric.

4. The apparatus of claim 1 wherein the drawstring pouch is made out of a synthetic fabric.

5. The apparatus of claim 1 wherein the tote bag is made out of a fabric comprising rayon.

6. The apparatus of claim 1 wherein the tote bag is made out of a fabric comprising acetate.

7. The apparatus of claim 1 wherein the tote bag is made out of a fabric comprising nylon.

8. The apparatus of claim 1 wherein the tote bag is made out of a fabric comprising a modacrylic.

9. The apparatus of claim 1 wherein the tote bag is made out of a fabric comprising an olefin.

10. The apparatus of claim 1 wherein the tote bag is made out of a fabric comprising an acrylic.

11. The apparatus of claim 1 wherein the tote bag is made out of a fabric comprising a polyester.

12. The apparatus of claim 1 wherein the tote bag is made out of a fabric comprising a lycra.

13. The apparatus of claim 1 wherein the tote bag is made out of a fabric comprising carbon fiber.

14. The apparatus of claim 1 wherein the drawstring pouch is made out of a fabric comprising rayon.

15. The apparatus of claim 1 wherein the drawstring pouch is made out of a fabric comprising an acetate.

16. The apparatus of claim 1 wherein the drawstring pouch is made out of a fabric comprising nylon.

17. The apparatus of claim 1 wherein the drawstring pouch is made out of a fabric comprising a modacrylic.

18. The apparatus of claim 1 wherein the drawstring pouch is made out of a fabric comprising an olefin, acrylic, polyester, lycra or carbon fiber.

19. The apparatus of claim 1 wherein the drawstring pouch is sewn together by a seam that does not come all the way up to the seam thereby leaving a seam opening.

20. The apparatus of claim 1 wherein the drawstring pouch is made out of a two-way stretch material.

* * * * *